United States Patent [19]

Dasai

[11] Patent Number: 5,064,546

[45] **Date of Patent: * Nov. 12, 1991**

[54] LUBRICATING OIL COMPOSITION

[75] Inventor: Masashi Dasai, Ichihara, Japan

[73] Assignee: Idemitsu Kosan Co., Ltd., Tokyo, Japan

[ * ] Notice: The portion of the term of this patent subsequent to Oct. 11, 2005 has been disclaimed.

[21] Appl. No.: 168,931

[22] Filed: Mar. 16, 1988

[30] Foreign Application Priority Data

Apr. 11, 1987 [JP] Japan ..... 62-087933

[51] Int. Cl.[5] ..... C10M 129/74; C10M 137/04

[52] U.S. Cl. ..... 252/32.5; 252/51.5 A; 252/56 R; 252/45; 208/18; 208/19

[58] Field of Search ..... 252/32.5, 45, 51.5 A, 252/56 R; 208/18, 19

[56] References Cited

U.S. PATENT DOCUMENTS

| | | | |
|---|---|---|---|
| 3,403,092 | 9/1968 | Rausch | 208/36 |
| 3,915,843 | 10/1975 | Franck et al. | 208/18 |
| 4,256,593 | 3/1981 | Nozawa | 208/18 |
| 4,372,839 | 2/1983 | Oleck et al. | 208/18 |
| 4,376,036 | 3/1983 | Garwood et al. | 208/120 |
| 4,776,967 | 10/1988 | Ichihashi et al. | 252/32.7 E |
| 4,812,246 | 3/1989 | Yabe | 252/32.7 E |
| 4,853,139 | 8/1989 | Ichihashi et al. | 252/32.7 E |
| 4,938,880 | 7/1990 | Waddoups et al. | 252/51.5 A |

FOREIGN PATENT DOCUMENTS

| | | |
|---|---|---|
| 1544802 | 11/1968 | France . |
| 1199936 | 7/1970 | United Kingdom . |

*Primary Examiner*—Jacqueline V. Howard

*Attorney, Agent, or Firm*—Frishauf, Holtz, Goodman & Woodward

[57] ABSTRACT

A lubricating oil composition comprising: (A) a base oil having a naphthene content of at least 30%, an aromatic content of not more than 2%, and a kinematic viscosity at 100° C. of 1.5 to 30 cSt; and (B) 0.01 to 5% by weight based on the total weight of the composition of a friction modifier. This composition is very useful as a lubricating oil for use in an automatic transmission or a continuously variable transmission, or as a lubricating oil for use in parts including a wet clutch or a wet brake of an agricultural tractor, etc.

32 Claims, No Drawings

LUBRICATING OIL COMPOSITION

BACKGROUND OF THE INVENTION

1. Field of the Invention

The present invention relates to a lubricating oil composition and more particularly to a lubricating oil composition which is excellent in frictional characteristics, is decreased in changes with time of the frictional characteristics and further is excellent in stability against oxidation or oxidation stability, and thus which is useful as a lubricating oil for use in various parts such as an automatic transmission, a continuously variable transmission, a brake of a tractor, a power steering and so forth.

2. Description of Related Art

A lubricating oil to be used in parts including a wet clutch or a wet brake of an automatic transmission, a continuously variable transmission, a tractor and so forth is required to have such properties that frictional characteristics, oxidation stability, corrosion resistance and rust resistance are good, and transmission torque is large. An especially important requirement is that the ratio of coefficient of static friction to coefficient of kinematic friction as a measure of frictional characteristics is small and further that the change with time of the above ratio is small.

A lubricating oil having a high coefficient of static friction and result in good transmission torque has heretofore been known. This lubricating oil, however, has disadvantages in that frictional characteristics are not sufficiently satisfactory and shift shock is undesirably big.

In recent years, with miniaturization of cars and with increased production of FF (front engine, front wheel driven) cars, a tendency toward miniaturization of an automatic transmission and so forth has been increasingly developed. This miniaturization of the automatic transmission makes a driver more sensitive to the shift shock. Thus, in order to reduce the shift shock and to make a car more comfortable to drive, it has become a technical subject to improve frictional characteristics, especially at an initial stage.

In order to improve frictional characteristics, a lubricating oil containing a friction modifier has been proposed. This friction modifier-containing lubricating oil, however, is not sufficiently improved in frictional characteristics and further has a problem in that the frictional characteristics are reduced by degradation of oil due to its long term use (change with time). Moreover there is a tendency that the corrosion preventing ability drops.

As described above there has not yet been obtained a lubricating oil which possesses frictional characteristics which are good and are decreased in the change with time, and further which has a high transmission torque.

SUMMARY OF THE INVENTION

The present invention is intended to overcome the above problems and an object of the present invention is to provide a lubricating oil composition which is decreased in shift shock, is great in transmission torque, and further has a sufficiently high corrosion-preventing ability, and thus which is suitable for use in lubrication of an automatic transmission and so forth.

It has been found that the object can be attained by compounding a specified proportion of a friction modifier to a base oil having specified properties.

The present invention relates to a lubricating oil composition comprising:

(A) a base oil having a naphthene content of at least 30%, an aromatic content of not more than 2%, and a kinematic viscosity at 100° C. of 1.5 to 30 cSt; and (B) 0.01 to 5% by weight based on the total weight of the composition of a friction modifier.

DESCRIPTION OF PREFERRED EMBODIMENTS

The base oil as the component (A) of the present composition is an oil having a naphthene content (% $C_N$) of at least 30%, preferably 32 to 70%, an aromatic content (% $C_A$) of not more than 2%, preferably not more than 1%, and a kinematic viscosity at 100° C. of 1.5 to 30 cSt, preferably 2 to 20 cSt. If the naphthene content is less than 30%, frictional characteristics are reduced. If the aromatic content is more than 2%, oxidation stability is poor and the change with time is undesirably large. Moreover, if the kinematic viscosity at 100° C. is less than 1.5 cSt, the evaporation loss is undesirably large while on the other hand if it is more than 30 cSt, the power loss due to viscosity resistance is undesirably too large.

It is preferred for the base oil of the component (A) to have such characteristics as required for the usual lubricating oil, for example, (1) proper viscosity characteristics, (2) good stability against oxidation, (3) good detergency and dispersancy, (4) good rust resistance and corrosion resistance, (5) good low temperature fluidity, and so forth. Specifically, it is more preferred for the base oil to have a viscosity index of at least 75, particularly at least 80, a pour point of not more than −10° C., particularly not more than −20° C., most preferably not more than −30° C., and a total acid value of 0.1 mg KOH/g.

As the base oil of the component (A), various mineral oils and synthetic oils can be used as long as they have the above specified properties.

Representative examples of the mineral oil which can be used as the base oil of the component (A) include a purified oil which is obtained by purifying a distillate oil by the usual method, said distillate oil having been obtained by atmospheric distillation of a paraffin base crude oil or an intermediate base crude oil, or by vacuum distillation of a residual oil resulting from the atmospheric distillation, and a deep dewaxing oil which is obtained by subjecting the above purified oil to deep dewaxing treatment. In this case, the process for purification of the distillate oil is not critical, and various methods can be employed. Usually, the distillate oil is purified by applying such treatments as (a) hydrogenation, (b) dewaxing (solvent dewaxing or hydrogenation dewaxing), (c) solvent extraction, (d) alkali distillation or sulfuric acid treatment, and (e) clay filtration, alone or in combination with one another. It is also effective to apply the same treatment repeatedly at multi-stages. For example, (1) a method in which the distillate oil is hydrogenated, or after hydrogenation, it is further subjected to alkali distillation or sulfuric acid treatment, (2) a method in which the distillate oil is hydrogenated and then is subjected to dewaxing treatment, (3) a method in which the distillate oil is subjected to solvent extraction treatment and then to hydrogenation treatment, (4) a method in which the distillate oil is subjected to two- or three-stage hydrogenation treatment, or after the two or three-stage hydrogenation treatment, it is further subjected to alkali distillation or sulfuric acid rinsing treatment, (5) a method in which after the treatment of the distillate oil by the methods (1) to (4) as described above, it is again subjected to a dewaxing treatment to obtain a deep dewaxed oil, and so forth can be employed.

In the practice of the above methods, it suffices that processing conditions be controlled so that the resulting oil has a kinematic viscosity at 100° C., a naphthene content and an aromatic content all falling within the above-specified ranges.

A mineral oil obtained by deep dewaxing, i.e., deep dewaxed oil is particularly preferred as the base oil of the component (A). This deep dewaxing is carried out by solvent dewaxing under severe conditions, catalytic hydrogenation dewaxing using a zeolite catalyst, and so forth.

As well as the aforementioned mineral oil, usual synthetic oils such as alkylbenzene, polybutene and poly(α-olefin), a synthetic oil containing saturated hydrocarbons having fused rings and/or non-fused rings such as 1-(1-decalyl)-1-cyclohexylethane or mixtures thereof can be used as the base oil of the component (A).

The friction modifier as the component (B) of the present composition is added to the base oil as the component (A) in a proportion of 0.01 to 5% by weight, preferably 0.1 to 2% by weight based on the total weight of the composition. If the proportion of the friction modifier is less than 0.01% by weight, its addition is not effective. On the other hand, if it is more than 5% by weight, oxidation stability is undesirably reduced.

As the friction modifier which is used as the component (B) of the present composition, compounds commonly called an oiliness agent, a friction preventing agent, an extreme pressure agent and so forth can be used. Preferred examples of such friction modifiers include phosphoric acid esters, phosphorous acid esters, amine salts of phosphoric acid esters, amine salts of phosphorous acid esters, sorbitan fatty acid esters, pentaerythritol fatty acid esters, glycerine fatty acid esters, trimethylolpropane fatty acid esters, glycol fatty acid esters, carboxylic acids, carboxylic acid amides, carboxylic acid esters, metal salts of carboxylic acids, fats and oils, higher alcohols, and sulfur-containing compounds. These compounds can be used alone or in combination with one another.

Of the above phosphoric acid esters and phosphorous acid esters, those represented by the following general formulae (I), (II) and (III) are preferred.

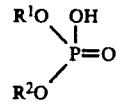
(I)

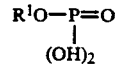
(II)

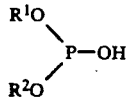
(III)

In the above formulae (I), (II) and (III), $R^1$ and $R^2$ may be the same or different and are each an alkyl group having 4 to 30 carbon atoms, an aryl group, or an alkyl-substituted aryl group.

Representative examples of the phosphoric acid esters and phosphorous acid esters include butylacid phosphate, 2-ethylhexylacid phosphate, laurylacid phosphate, oleylacid phosphate, stearylacid phosphate, dibutylhydrogen phosphite, dilaurylhydrogen phosphite, dioleylhydrogen phosphite, distearylhydrogen phosphite, diphenylhydrogen phosphite and the like.

The amine salts of phosphoric acid esters and phosphorous acid esters include the oleylamine salts, coconut amine salts, beef tallow amine salts of the above phosphoric acid esters and phosphorous acid esters.

Representative examples of sorbitan fatty acid esters include sorbitan monolaurate, sorbitan monooleate, sorbitan monostearate, sorbitan sesqueoleate, sorbitan dioleate and mixtures thereof.

Representative examples of pentaerythritol fatty acid esters include the monoesters, diesters or triesters of pentaerythritol or dipentaerythritol and fatty acids such as capric acid, lauric acid, myristic acid, palmitic acid, stearic acid, oleic acid, linolic acid and behenic acid, and mixtures thereof.

Representative examples of glycerine fatty acid esters include oleic monoglyceride, stearic monoglyceride, oleic diglyceride and mixtures thereof.

Representative examples of trimethylolpropane fatty acid esters include the monoesters or diesters of trimethylpropane and fatty acids such as capric acid, lauric acid, myristic acid, palmitic acid, stearic acid, oleic acid, linolic acid and behenic acid, and mixtures thereof.

Representative examples of glycol fatty acid esters include the monoesters of propylene glycol, trimethylene glycol, 1,4-butanediol or neopentyl glycol and fatty acids such as capric acid, lauric acid, palmitic acid, myristic acid, stearic acid, oleic acid, linolic acid and behenic acid, and mixtures thereof.

As carboxylic acids, aliphatic carboxylic acids, divalent carboxylic acids (dibasic acids) and aromatic carboxylic acids can be used. The aliphatic carboxylic acids have 8 to 30 carbon atoms and may be saturated or unsaturated. Representative examples of the aliphatic carboxylic acid includes pelargonic acid, lauric acid, tridecanic acid, myristic acid, palmitic acid, stearic acid, eicosanic acid, behenic acid, triacontanoic acid, undecylenic acid, oleic acid, linolic acid, linoleic acid, erucic acid, and oils and fats fatty acids (e.g., coconut oil fatty acid, palm kernel oil fatty acid and the like). Representative examples of the divalent carboxylic acid include octadecylsuccinic acid, octadecenylsuccinic acid, polybutenylsuccinic acid, adipic acid, azelaic acid, sebacic acid, dodecane diacid and the like. The aromatic carboxylic acid includes salicylic acid and the like.

As the carboxylic acid amide, various compounds can be used. For example, the reaction products of carboxylic acids as described above and amine compounds (e.g., diethylenetriamine, triethylenetetramine, tetraethylenepentamine, hexaethylenepentamine, heptaethyleneoctamine, tetrapropylenepentamine, hexabutyleneheptamine, and alkanolamines such as monoethanolamine, diethanolamine and the like) can be used.

Carboxylic acid esters include aliphatic carboxylic acid esters and dicarboxylic acid esters (dibasic acid esters). As the aliphatic carboxylic acid esters, the alkyl (e.g., methyl, ethyl, propyl, butyl, octyl, lauryl, and oleyl) esters of aliphatic carboxylic acids as described above are usually used. The divalent carboxylic acid esters include the monoalkyl esters or glycol (e.g., propylene glycol) esters of divalent carboxylic acids as described above.

As the carboxylic acid metal salts, zinc laurate, zinc oleate, zinc stearate, zinc salt of coconut fatty acid, aluminum stearate, magnesium salicylate and the like can be used.

As the fats and oils, both animal oils and vegetable oils can be used. Examples of the animal oils include lard, beef tallow, fish oil and the like. Examples of the vegetable oils include soy bean oil, rapeseed oil, rice bran oil, palm oil, palm kernel oil, coconut oil and the like.

As the higher alcohols, octyl alcohol, lauryl alcohol, myristyl alcohol, oleyl alcohol, stearyl alcohol and the like.

As the sulfur-containing compounds, sulfurized oil, tee reaction product of phosphorous sulfide and pinene, and the like can be used.

The above compounds can be used as the component (B), friction modifier, of the composition of the present invention. Of these compounds, phosphoric acid esters, phosphorous acid esters or their amine salts, carboxylic acid amides, glycerine fatty acid esters, sorbitan fatty acid esters, carboxylic acid metal salts, dicarboxylic acid esters (dibasic acid esters) and mixtures comprising two or more thereof are preferred.

The composition of the present invention is obtained by adding a friction modifier as the component (B) to a base oil as the component (A). If desired, a viscosity index improver, an antioxidant, a detergent dispersant and so forth can be added to the composition of the present invention.

The type of the viscosity index improver is not critical. For example, polymethacrylate, polyisobutene, polyalkylstyrene, an ethylene-propylene copolymer and so forth can be used. Of these, polymethacrylate having a molecular weight of not more than 100,000, preferably not more than 50,000, which is excellent in shear stability and is able to prevent changes in viscosity for a long time, is particularly suitable. The amount of the viscosity index improver added can be determined appropriately; usually, it is 0.5 to 15% by weight, preferably 2 to 10% by weight based on the total weight of the composition.

As the antioxidant, compounds commonly used, such as phenol-based compounds, amine-based compounds, zinc dithiophosphate and the like can be used. Representative examples are 2,6-di-tert-butyl-4-methylphenol, 2,6-di-tert-butyl-4-ethylphenol, 4,4'-methylenebis(2,6-di-tert-butylphenol), phenyl-α-naphthylamine, dialkyldiphenylamine, zinc di-2-ethylhexyldithiophosphate, zinc diamyldithiocarbamate, pinene pentasulfide and the like. The amount of the antioxidant added is 0.01 to 2% by weight, preferably 0.05 to 1% by weight based on the total weight of the composition.

As the detergent dispersant, an ashless detergent, a metal detergent and the like can be used. In addition, a boron-containing ashless detergent can be used. Specifically alkenylsuccinic acid imide, sulfonates, phenates and the like are preferred. Examples are polybutenylsuccinic acid imide, calcium sulfonate, barium sulfonate, calcium sulfinate, barium sulfinate, calcium salicynate and the like. The amount of the detergent dispersant added is 0.1 to 10% by weight, preferably 0.5 to 5% by weight based on the total weight of the composition.

In addition, if necessary, suitable amounts of a corrosion preventing agent, a rubber swelling agent, a defoaming agent and the like can be added to the composition of the present invention.

In the lubricating oil composition of the present invention, initial frictional characteristics are good, that is, the ratio of coefficient of static friction to coefficient of kinematic friction is small, and the shock due to speed change is small. Changes with time of the frictional characteristics are small. Furthermore, the lubricating oil composition of the present invention is excellent in oxidation stability and corrosion resistance. Thus the lubricating oil composition of the present invention is suitable for miniaturization of a transmission and so forth.

Accordingly the lubricating oil composition of the present invention is quite useful as a lubricating oil for use in an automatic transmission or a stepless transmission, or as a lubricating oil for use in parts including a wet clutch or a wet brake of an agricultural tractor and the like.

Moreover the lubricating oil composition of the present invention having characteristics as described above is useful as a lubricating oil to be used in a shock absorber, a power steering, an oil suspension and further in various construction machines and so forth.

The present invention is described in greater detail with reference to the following examples.

EXAMPLES 1 to 10, and COMPARATIVE EXAMPLES 1 to 11

(1) Preparation of Lubricating Oil Composition

Base Oils A to E shown below were used as the base oil. To 89.3% by weight of each of Base Oils A to E were added 4.0% by weight of polymethyl methacrylate (weight average molecular weight: 42,000), 0.5% by weight of 2,6-di-tert-butyl-4-methylphenol, 5.0% by weight of polybutenylsuccinic acid imide, 0.1% by weight of an anti-corrosion agent, 1.0% by weight of a rubber swelling agent and 1% by weight of a defoaming agent to prepare Basic Oils A to E.

To these Basic Oils A to E were added the compounds shown in the table in predetermined amounts to obtain lubricating oil compositions.

Basic Oil A (1) Properties
Viscosity: 5.40 cSt (100° C.)
Viscosity Index: 105
Ring Analysis: % $C_A$0.1, % $C_N$38.0
Pour Point: −45° C.
(2) Method of Preparation
Obtained by subjecting a distillate from an intermediate base oil to two-stage hydrogenation treatment and further to deep dewaxing treatment.

Base Oil B (1) Properties
Viscosity: 5.20 cSt (100° C.)
Viscosity Index: 105
Ring Analysis: % $C_A$4.5, % $C_N$27.0
(2) Method of Preparation
Obtained by subjecting a distillate from an intermediate base oil to solvent extraction treatment and further to hydrogenation treatment.

Base Oil C (1) Properties
Viscosity: 5.45 cSt (100° C.)
Viscosity Index: 83

Ring Analysis: % $C_A$1.5, % $C_N$50

(2) Method of Preparation

Mixture of 40% by weight of Base Oil A, 30% by weight of an oil obtained by subjecting a distillate from an intermediate base oil to hydrogenation treatment, and 30% by weight of 1-(1-decalyl)-1-cyclohexylethane.

Base Oil D (1) Properties

Viscosity: 5.6 cSt (100° C.)

Viscosity Index: 120

Ring Analysis: % $C_A$0.1 or less % $C_N$19

(2) Method of Preparation

Mixture of 50% by weight of Base Oil A and 50% by weight of poly-α-olefin.

Base Oil E (1) Properties

Viscosity: 5.1 cSt (100° C.)

Viscosity Index: 60

Ring Analysis: % $C_A$4, % $C_N$40

(2) Method of Preparation

Obtained by subjecting a distillate from a naphthenic oil to solvent extraction treatment.

(2) Performance Test

The lubricating oil compositions prepared in (1) above, just after preparation thereof and after forced degradation, were subjected to the following performance test. The results are shown in the table. The forced degradation was performed at 150° C. for 24 hours according to Oxidation Stability Test of Lubricating Oil for Internal Combustion Engine, JIS K 2514.

SAE (Society of Automotive Engineers) No. 2 Friction Test

Frictional characteristics were evaluated under the conditions shown below by the use of SAE No. 2 tester (manufactured by Greening Association Inc.)

Test Conditions

Disc: Two paper discs for an automatic transmission made in Japan

Plate: Three steel plates for an automatic transmission in Japan

Number of revolutions of motor: 3,600 rpm

Piston pressure: 38 psi

Oil Temperature: 120° C.

A coefficient of kinematic friction ($\mu_{1200}$) at a number of revolutions of 1,200 rpm under the above conditions and a coefficient of static friction ($\mu_O$) at the time of stop were measured, and $\mu_O/\mu_{1200}$ was calculated.

Oxidation Stability Test

This test was performed at 150° C. for 96 hours according to Oxidation Stability Test of Lubricating Oil for Internal Combustion Engine, JIS K 2514.

Corrosion Test

The state of corrosion of a copper plate was measured after 3 hours at 100° C. according to JIS K 2513.

TABLE

| | Example | | | | | | | | | | Comparative Example | | |
|---|---|---|---|---|---|---|---|---|---|---|---|---|---|
| | 1 | 2 | 3 | 4 | 5 | 6 | 7 | 8 | 9 | 10 | 1 | 2 | 3 |
| Component of the Composition (wt %) | | | | | | | | | | | | | |
| Basic Oil A | 99.0 | 99.5 | 99.5 | 99.9 | 99.0 | 99.0 | — | 99.5 | 99.5 | 99.5 | — | — | — |
| Basic Oil B | — | — | — | — | — | — | — | — | — | — | 99.0 | 99.5 | 99.5 |
| Basic Oil C | — | — | — | — | — | — | 99.0 | — | — | — | — | — | — |
| Basic Oil D | — | — | — | — | — | — | — | — | — | — | — | — | — |
| Basic Oil E | — | — | — | — | — | — | — | — | — | — | — | — | — |
| Amine Salt of Oleyl-hydrogen Phosphite | 1.0 | — | — | — | — | — | 1.0 | — | — | — | 1.0 | — | — |
| Oleyl acid Phosphate | — | 0.5 | — | — | — | — | — | 0.5 | — | — | — | 0.5 | — |
| Laurylhydrogen Phosphite | — | — | 0.5 | — | — | — | — | — | — | — | — | — | 0.5 |
| Stearic Acid | — | — | — | 0.1 | — | — | — | — | 0.5 | — | — | — | — |
| Oleyl Alcohol | — | — | — | — | 1.0 | — | — | — | — | 0.5 | — | — | — |
| Sorbitan Monooleate | — | — | — | — | — | 1.0 | — | — | — | — | — | — | — |
| Results | | | | | | | | | | | | | |
| SAE No. 2 Test ($\mu_O/\mu_{1200}$) | | | | | | | | | | | | | |
| Fresh Oil | 1.04 | 1.08 | 1.00 | 1.08 | 1.05 | 1.05 | 1.02 | 0.98 | 0.98 | 0.99 | 1.07 | 1.14 | 1.02 |
| Degradated Oil | 1.04 | 1.08 | 1.00 | 1.10 | 1.07 | 1.06 | 1.04 | 0.98 | 0.98 | 0.99 | 1.10 | 1.22 | 1.07 |
| Oxidation Stability Test | | | | | | | | | | | | | |
| Viscosity Ratio | 0.98 | 0.99 | 0.98 | 1.00 | 1.00 | 0.99 | 1.02 | 0.97 | 0.98 | 0.98 | 1.12 | 1.20 | 1.09 |
| Increase in Total Acid Value | 0.13 | 0.23 | 0.15 | 0.31 | 0.24 | 0.10 | 0.51 | 0.12 | 0.14 | 0.15 | 1.33 | 1.97 | 1.42 |
| Lacquer | no | no | no | no | no | no | no | no | no | no | no | no | no |
| Corrosion Test | 1(1a) | 1(1a) | 1(1a) | 1(1a) | 1(1a) | 1(1a) | 1(1a) | 1(1a) | 1(1a) | 1(1a) | 1(1a) | 1(1a) | 1(1a) |

| | Comparative Example | | | | | | | |
|---|---|---|---|---|---|---|---|---|
| | 4 | 5 | 6 | 7 | 8 | 9 | 10 | 11 |
| Component of the Composition (wt %) | | | | | | | | |
| Basic Oil A | — | — | — | — | — | — | — | — |
| Basic Oil B | 99.9 | 99.0 | 99.0 | — | — | 99.5 | 99.5 | 99.5 |
| Basic Oil C | — | — | — | — | — | — | — | — |
| Basic Oil D | — | — | — | 99.0 | — | — | — | — |
| Basic Oil E | — | — | — | — | 99.0 | — | — | — |
| Amine Salt of Oleyl-hydrogen Phosphite | — | — | — | 1.0 | 1.0 | — | — | — |
| Oleyl acid Phosphate | — | — | — | — | — | 0.5 | — | — |
| Laurylhydrogen Phosphite | — | — | — | — | — | — | — | — |
| Stearic Acid | 0.1 | — | — | — | — | — | 0.5 | — |
| Oleyl Alcohol | — | 1.0 | — | — | — | — | — | 0.5 |

TABLE -continued

| | | | | | | | | |
|---|---|---|---|---|---|---|---|---|
| Sorbitan Monooleate | — | — | 1.0 | — | — | — | — | — |
| Results | | | | | | | | |
| SAE No. 2 Test ($\mu_0/\mu_{1200}$) | | | | | | | | |
| Fresh Oil | 1.13 | 1.09 | 1.08 | 1.09 | 1.04 | 1.02 | 1.02 | 1.04 |
| Degradated Oil | 1.19 | 1.14 | 1.12 | 1.10 | 1.07 | 1.05 | 1.05 | 1.07 |
| Oxidation Stability Test | | | | | | | | |
| Viscosity Ratio | 1.19 | 1.07 | 1.09 | 0.98 | 1.10 | 1.05 | 1.08 | 1.10 |
| Increase in Total Acid Value | 3.32 | 1.11 | 1.43 | 0.11 | 1.00 | 1.39 | 1.42 | 1.43 |
| Lacquer | no | no | no | no | no | no | no | no |
| Corrosion Test | 1(1a) | 1(1a) | 1(1a) | 1(1a) | 1(1a) | 1(1a) | 1(1a) | 1(1a) |

What is claimed is:

1. A lubricating oil composition comprising:

(A) a base oil having a naphthene content of at least 30%, an aromatic content of not more than 2%, and a kinematic viscosity at 100° C. of 1.5 to 30 cSt; and (B) 0.01 to 5% by weight based on the total weight of the composition of a friction modifier.

2. The composition as claimed in claim 1 wherein the friction modifier (B) is at least one compound selected from the group consisting of phosphoric acid esters, phosphorous acid esters, amine salts of phosphoric acid esters, amine salts of phosphorous acid esters, sorbitan fatty acid esters, pentaerythritol fatty acid esters, glycerine fatty acid esters, trimethylolpropane fatty acid esters, glycol fatty acid esters, carboxylic acids, carboxylic acid amides, carboxylic acid esters, metal salts of carboxylic acids, fats and oils, higher alcohols and sulfur-containing compounds.

3. The composition as claimed in claim 1 wherein the base oil (A) is a mineral oil.

4. The composition as claimed in claim 3 wherein the mineral oil is a deep dewaxed oil obtained by subjecting a purified oil to deep dewaxing treatment.

5. The lubricating oil composition as claimed in claim 1, wherein said naphthene content of said base oil is 32 to 70%.

6. The lubricating oil composition as claimed in claim 5, wherein said aromatic content of said base oil is not more than 1%.

7. The lubricating oil composition as claimed in claim 6, wherein said kinematic viscosity of said base oil at 100° is 2 to 20 cSt.

8. The lubricating oil composition as claimed in claim 3, wherein the mineral oil is a purified oil which is obtained by purifying a distillate oil, said distillate oil being obtained by atmospheric distillation of a paraffin base crude oil or an intermediate base crude oil, or by a vacuum distillation of a residual oil.

9. The lubricating oil composition as claimed in claim 7, wherein the % by weight of said friction modifier is 0.1 to 2% by weight.

10. The lubricating oil composition as claimed in claim 9, wherein the friction modifier is a phosphoric acid ester or a phosphorous acid ester of the formulae

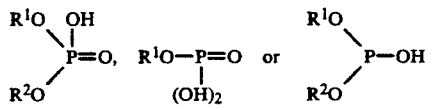

wherein $R^1$ and $R^2$ are the same or different and are an alkyl group having 4 to 30 carbon atoms, an aryl group or an alkyl-substituted aryl group.

11. The lubricating oil composition as claimed in claim 9, wherein the friction modifier is a phosphoric acid ester or a phosphorous acid ester selected from the group consisting of butylacid phosphate, 2-ethylhexylacid phosphate, laurylacid phosphate, oleylacid phosphate, stearylacid phosphate, dibutylhydrogen phosphite, dilaurylhydrogen phosphite, dioleylhydrogen phosphite, distearylhydrogen phosphite and diphenylhydrogen phosphite, 12. The lubricating oil composition as claimed in claim 9, wherein the friction modifier is an amine salt of a phosphoric acid ester or a phosphorous acid ester selected from the group consisting of the an oleylamine salt, a coconut amine salt and a beef tallow amine salt of a phosphoric acid ester or a phosphorous acid ester selected from the group consisting of butylacid phosphate, 2-ethylhexylacid phosphate, laurylacid phosphate, oleylacid phosphate, stearylacid phosphate, dibutylhydrogen phosphite, dilaurylhydrogen phosphite, dioleylhydrogen phosphite, distearylhydrogen phosphite and diphenylhydrogen phosphite.

13. The lubricating oil composition as claimed in claim 9, wherein the friction modifier is a sorbitan fatty acid selected from the group consisting of sorbitan monolaurate sorbitan monooleate, sorbitan monostearate, sorbitan sesqueoleate. sorbitan dioleate and mixtures thereof. of pentaerythritol or dipentaerythritol and a fatty acid selected from the group consisting of capric acid, lauric acid, myristic acid, palmitic acid, stearic acid, oleic acid, linolic acid, behenic acid, and mixtures thereof.

14. The lubricating oil composition as claimed in claim 9, wherein the friction modifier is a glycerine fatty acid ester selected from the group consisting of oleic monoglyceride, stearic monoglyceride, oleic diglyceride and mixtures thereof.

15. The lubricating oil composition as claimed in claim 9, wherein the friction modifier is a monoester or diester of trimethylolpropane and a fatty acid selected from the group consisting of capric acid, lauric acid, myristic acid, palmitic acid, stearic acid, oleic acid, linolic acid, behenic acid and mixtures thereof.

16. The lubricating oil composition as claimed in claim 9, wherein the friction modifier is a glycol fatty acid ester comprising a monoester of a glycol selected from the group consisting of propylene glycol, trimethylene glycol, 1,4-butanediol and neopentyl glycol and a fatty acid selected from the group consisting of capric acid, lauric acid, palmitic acid, myristic acid, stearic acid, oleic acid, linolic acid, behenic acid and mixtures thereof.

17. The lubricating oil composition as claimed in claim 9, wherein the friction modifier is a carboxylic acid selected from the group consisting of aliphatic carboxylic acids having 8 to 30 carbon atoms, divalent carboxylic acids and aromatic carboxylic acids.

18. The lubricating oil composition as claimed in claim 9, wherein the friction modifier is selected from the group consisting of pelargonic acid, lauric acid, tridecanic acid, myristic acid, palmitic acid, stearic acid, eicosanic acid, behenic acid, triacontanoic acid, undecylenic acid, oleic acid, linolic acid, linoleic acid, coconut oil fatty acid, palm kernel oil fatty acid, octadecylsuccinic acid, octadecenylsuccinic acid, polybutenylsuccinic acid, adipic acid, azelaic acid, sebacic acid, dodecane diacid and salicylic acid.

19. The lubricating oil composition as claimed in claim 9, wherein the friction modifier is a carboxylic acid amide produced by the reaction product of a carboxylic acid and an amine compound selected from the group consisting of diethylenetriamine, triethylenetetramine, tetraethylenepentamine, hexaethylenepentamine, heptaethyleneoctamine, tetrapropylenepentamine, hexabutyleneheptamine, monoethanolamine and diethanolamine.

20. The lubricating oil composition as claimed in claim 9, wherein the friction modifier is a carboxylic metal salt selected from the group consisting of zinc laurate, zinc oleate, zinc stearate, zinc salt of coconut fatty acid, aluminum stearate and magnesium salicylate.

21. The lubricating oil composition as claimed in claim 9, wherein the friction modifier is a fat or oil selected from the group consisting of lard, beef tallow, fish oil, soy bean oil, rapeseed oil, rice bran oil, palm oil, palm kernel oil and coconut oil.

22. The lubricating oil composition as claimed in claim 9 wherein the friction modifier is a higher alcohol selected from the group consisting of octyl alcohol, lauryl alcohol, myristyl alcohol, oleyl alcohol and stearyl alcohol.

23. The lubricating oil composition s claimed in claim 9, wherein the friction modifier is an aliphatic carboxylic acid ester or a dicarboxylic acid ester.

24. The lubricating oil composition as claimed in claim 9, wherein the friction modifier is a sulfur-containing compound selected from the group consisting of sulfurized oil and the reaction product of phosphorous sulfide and pinene.

25. The lubricating oil composition as claimed in claim 9, wherein said base oil has a naphthene content of 38%, an aromatic content of 0.1% and a kinematic viscosity of 5.4 cSt at 100° C.

26. The lubricating oil composition a claimed in claim 25, wherein said base oil is contained in an amount of 99 wt. % and said friction modifier is an amine salt of oleyl hydrogen phosphite contained in an amount of 1 wt. %.

27. The lubricating oil composition a claimed in claim 25, wherein said base oil is contained in an amount of 99.5 wt. % and said friction modifier is oleyl acid phosphate contained in an amount of 0.5 wt. %.

28. The lubricating oil composition as claimed in claim 25, wherein said base oil is contained in an amount of 99.5 wt. % and said friction modifier is lauryl hydrogen phosphite contained in an amount of 0.5 wt. %.

29. The lubricating oil composition s claimed in claim 25, wherein said base oil is contained in an amount of 99.9 wt. % and said friction modifier is stearic acid contained in an amount of 0.1 wt. %.

30. The lubricating oil composition as claimed in claim 25, wherein said base oil is contained in an amount of 99 wt. % and said friction modifier is oleyl alcohol contained in an amount of 0.1 wt. %.

31. The lubricating oil composition as claimed in claim 25, wherein said base oil is contained in an amount of 99 wt. % and said friction modifier is sorbitan monooleate contained in an amount of 0.1 wt. %.

32. The lubricating oil composition as claimed in claim 9, wherein the friction modifier is a pentaerythritol fatty acid ester selected from the group consisting of a monoester, a diester and a triester of pentaerythritol or dipentaerythritol and a fatty acid selected from the group consisting of capric acid, lauric acid, myristic acid, palmitic acid, stearic acid, oleic acid, linolic acid, behenic acid, and mixtures thereof.

* * * * *

UNITED STATES PATENT AND TRADEMARK OFFICE

CERTIFICATE OF CORRECTION

PATENT NO. : 5,064,546

DATED : November 12, 1991

INVENTOR(S) : Masashi DASAI

It is certified that error appears in the above-identified patent and that said Letters Patent is hereby corrected as shown below:

Title Page, right column, after the line starting "4,938,880", insert

| | | |
|---|---|---|
| --2,515,115 | 10/1947 | Davis et al |
| 2,603,604 | 7/1952 | Ballard et al |
| 2,683,119 | 7/1954 | Smith et al |
| 2,775,560 | 12/1956 | Lurton et al |
| 2,962,443 | 11/1960 | Rhodes |
| 3,184,408 | 5/1965 | Wilson et al |
| 3,235,499 | 2/1966 | Waldmann |
| 3,381,022 | 4/1968 | Le Suer |
| 3,658,707 | 4/1972 | Delafield et al |
| 3,720,615 | 3/1973 | Izumi et al |
| 4,209,411 | 6/1980 | Winans et al |
| 4,304,678 | 12/1981 | Schick et al |
| 4,336,149 | 6/1982 | Erdman |
| 4,376,056 | 3/1983 | Erdman |
| 4,491,527 | 1/1985 | Lange et al |
| 4,589,993 | 5/1986 | Cleveland et al |
| 4,664,822 | 5/1987 | Hunt et al |
| 4,683,069 | 7/1987 | Brewster et al |
| 4,767,551 | 8/1988 | Hunt et al--. |

UNITED STATES PATENT AND TRADEMARK OFFICE

CERTIFICATE OF CORRECTION

PATENT NO. : 5,064,546

DATED : November 12, 1991

INVENTOR(S) : Masashi DASAI

It is certified that error appears in the above-identified patent and that said Letters Patent is hereby corrected as shown below:

Title Page, right column, under the heading "FOREIGN PATENT DOCUMENTS", after the line starting "1199936", insert

| | | |
|---|---|---|
| --021838 | 6/1980 | Europe |
| 2 097 813 | 4/1982 | Great Britain |
| 1095 | 1/1985 | Japan |
| 19698 | 1/1986 | Japan |

OTHER DOCUMENTS

"Sekiyu Seihin Tenkaza" Sakurai Toshio (author) 10 August 1974 [p.224, line 24 to p.225, line 9 from the bottom].--

Column 10, line 40 (claim 13), delete "of pentaerythritol or dipentaerythritol".

Column 10, lines 41-44, delete all of the subject matter on these lines.

Signed and Sealed this

Fifteenth Day of November, 1994

*Attest:*

Bruce Lehman

BRUCE LEHMAN

*Attesting Officer*

*Commissioner of Patents and Trademarks*